US007394034B2

(12) United States Patent
Ostendorf et al.

(10) Patent No.: US 7,394,034 B2
(45) Date of Patent: Jul. 1, 2008

(54) ELECTRIC PUSH-BUTTON SWITCH WITH LIGHTING ARRANGEMENT

(75) Inventors: Jens Ostendorf, Hilzingen (DE); Juergen Girke, Reichenau (DE); Hans-Joachim Frohne, Lehre (DE)

(73) Assignee: TRW Automotive Electronics & Components GmbH & Co. Kg, Enkenbach Alsenborn (DE)

( * ) Notice: Subject to any disclaimer, the term of this patent is extended or adjusted under 35 U.S.C. 154(b) by 161 days.

(21) Appl. No.: 11/368,763

(22) Filed: Mar. 6, 2006

(65) Prior Publication Data

US 2006/0201796 A1 Sep. 14, 2006

(30) Foreign Application Priority Data

Mar. 8, 2005 (DE) ..... 20 2005 003 663 U

(51) Int. Cl.
*H01H 9/16* (2006.01)

(52) U.S. Cl. ..... 200/314

(58) Field of Classification Search ..... 200/314, 200/312

See application file for complete search history.

(56) References Cited

U.S. PATENT DOCUMENTS 4,683,359 A 7/1987 Wojtanek ..... 200/314
5,252,798 A 10/1993 Kamada ..... 200/314
5,403,984 A * 4/1995 Ogawa ..... 200/314
7,026,563 B2 * 4/2006 Miyako et al. ..... 200/314
2002/0021562 A1 2/2002 Tholin et al.

FOREIGN PATENT DOCUMENTS

| | | |
|---|---|---|
| DE | 3133134 | 3/1983 |
| DE | 3817797 | 5/1991 |
| DE | 4414981 | 11/1995 |
| DE | 19840070 | 3/2000 |
| EP | 1107268 | 6/2001 |
| EP | 1179828 | 2/2002 |

* cited by examiner

*Primary Examiner*—Renee S Luebke
(74) *Attorney, Agent, or Firm*—Tarolli, Sundheim Covell & Tummino LLP

(57) ABSTRACT

An electric push-button switch (10) includes a housing (22), a push-button (12). The push-button switch (10) further includes a symbol lighting arrangement to illuminate a transparent region (16) of the push-button (12). The transparent region (16) symbolizes the functional unit to be operated by the push-button switch (10) or an actual function of the functional unit. The push-button switch (10) further includes a function lighting arrangement to indicate the operating status of the functional unit. The symbol lighting arrangement comprises a first light source (32), and the function lighting arrangement comprises a second light source (34) and an off-partitioned light conducting section to a light outlet area (18) which is integrated into the push-button (12). Both lighting arrangements are accommodated in a structural space defined by the housing (22).

5 Claims, 1 Drawing Sheet

ELECTRIC PUSH-BUTTON SWITCH WITH LIGHTING ARRANGEMENT

TECHNICAL FIELD

The invention relates to an electric push-button switch, in particular an electric push-button switch in a motor vehicle to operate a functional unit.

BACKGROUND OF THE INVENTION

Push-button switches in motor vehicles are able to be found easily in the dark when a symbol on the operating surface of the push-button is illuminated by a symbol lighting arrangement. Generally, the symbol is illuminated when the headlights of the vehicle are switched on. With some push-button switches, it is efficient to inform the vehicle occupant of the current switching status of the push-button switch, e.g. as to whether a functional unit is switched on or off. An additional function lighting arrangement can be provided for this, having a outlet area in the push-button which is illuminated separately from the symbol lighting only as a function of the operating status of the functional unit which is to be operated.

In EP-A-1 107 268 a push-button switch is shown, which is part of a switch unit having several key switches. The push-button switch includes a housing and a push-button. The push-button switch further includes are symbol lighting arrangement to illuminate a transparent region of the push-button. The transparent region symbolizes the functional unit to be operated by the push-button switch. The push-button switch further includes a function lighting arrangement to indicate the operating status of the functional unit. The symbol lighting arrangement comprises a first light source and the function lighting arrangement comprises a second light source and an off-portioned light conducting section to a light outlet area. The light conducting section is integrated into the push-button. An incandescent bulb arranged outside the housing of the switch unit serves both for external "floodlight illumination" of the switch unit and also to illuminate the function symbols of the individual push-buttons. For this, the light of the incandescent bulb is directed via light conductors back into the housing and to the respective function symbols. This design is inefficient, however, for individual push-button switches and requires additional structural space. In addition, this solution is not suitable for applications in which an external illumination of the push-button switches could be felt to be intrusive.

It is an object of the invention to provide a compact electric push-button switch with efficient symbol and function lightings.

BRIEF SUMMARY OF THE INVENTION

According to the invention, an electric push-button switch includes a housing and a push-button. The push-button switch further includes a symbol lighting arrangement to illuminate a transparent region of the push-button. The transparent region symbolizes the functional unit to be operated by the push-button switch or an actual function of the functional unit. The push-button switch further includes a function lighting arrangement to indicate the operating status of the functional unit. The symbol lighting arrangement comprises a first light source, and the function lighting arrangement comprises a second light source and an off-partitioned light conducting section to a light outlet area which is integrated into the push-button. Both lighting arrangements are accommodated in a structural space defined by the housing. The symbol lighting therefore is accomplished by a light source arranged inside the push-button switch, the light conducting section of the function lighting being partitioned off from this light source and its stray light. This guarantees that, despite the confined structural space conditions, stray light can not reach from the first light source to the light outlet area, nor can stray light from the second light source arrive at the transparent region of the push-button. The complete integration of the two lighting arrangements into the push-button switch has the advantage that the push-button switch can be pre-assembled as an independent operable unit and can be placed at any desired locations in the vehicle.

For a shortened construction with respect to the actuating direction, space-saving LEDs can be used as light sources. The LEDs are preferably arranged directly on a common printed circuit board.

According to the preferred embodiment of the invention, the light conducting section comprises a light conductor, and a switching mat is arranged over the second light source, a form fit existing between the light conductor and the switching mat. This construction makes possible a pleasant 'feel' to the switch upon actuating the light switch and makes it possible for the light of the second light source to enter through the switching mat into the light conductor, free of stray light.

In this context, a construction in which the light conductor extends into a bore in the switching mat is particularly advantageous. Thereby, the function of the switching mat is not impaired through a movement of the light conductor in the actuating direction.

The construction of the light conductor as a light block which extends from the bore of the switching mat up to the push-button, has the advantage that the separation of the light conducting section from the second light source to the light outlet area can be realized in a simple manner with few components.

In the preferred embodiment of the invention, provision is further made that the push-button switch comprises a reflector which divides an interior of the push-button switch into two lighting areas, the first lighting area restricting the outlet of the light of the first light source substantially to the transparent area, and the light conductor being guided in the second lighting area. The reflector thereby undertakes a dual function which makes it possible to make savings as regards components and structural space.

DETAILED DESCRIPTION OF THE PREFERRED EMBODIMENT

Figure 1:
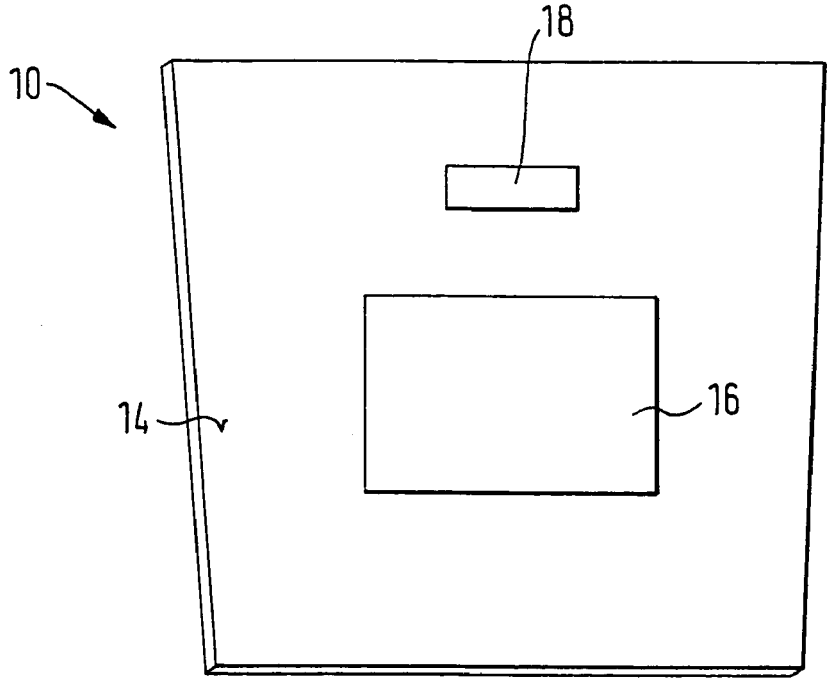
FIG. 1 shows a front view of an electric push-button switch according to the invention.
Figure 2:
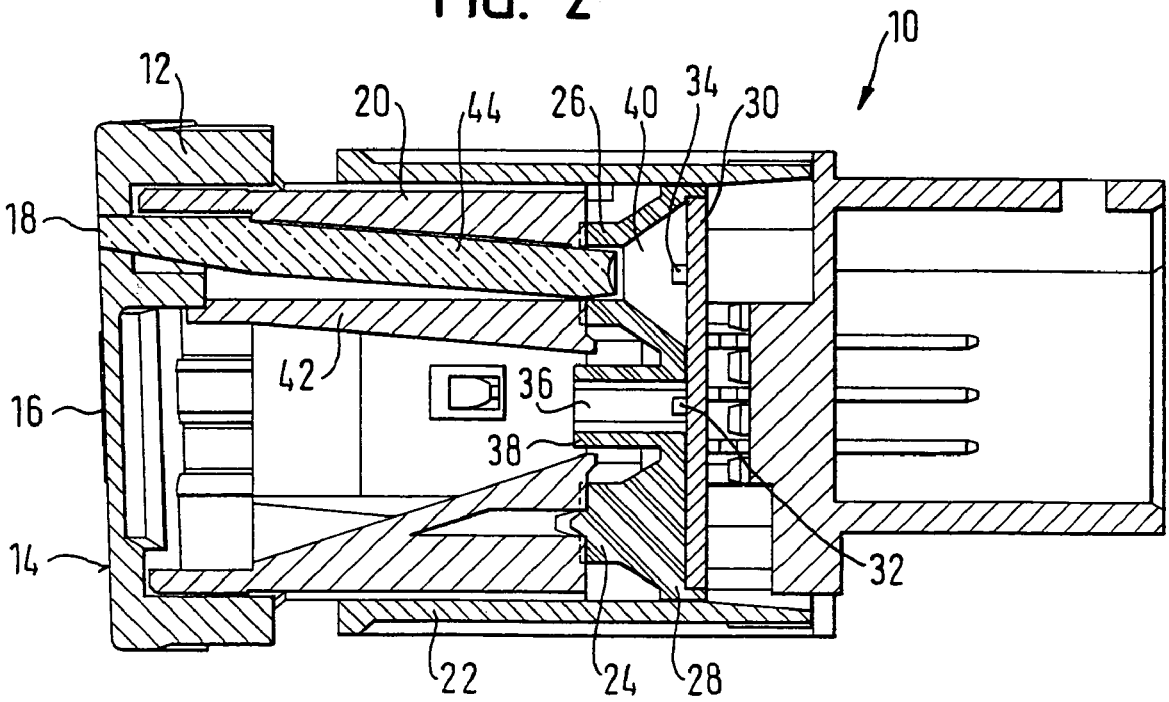
FIG. 2 shows a lateral sectional view of the push-button switch of FIG. 1.

The switch 10 illustrated in FIGS. 1 and 2 is an electric push-button switch which is provided for operating a particular functional unit in a motor vehicle. The push-button switch 10 has a housing 22 and a movable push-button 12 with an operating surface 14. The operating surface 14 has a transparent symbol 16 which represents the functional unit or an actual function of the functional unit. A light outlet surface 18, by which the vehicle occupant is informed of the operating status of the functional unit, is situated over the symbol 16. The housing 22 and/or the push-button 12, which are constructed here in one piece respectively, can also be composed of several parts.

The structure of the push-button switch 10 can be seen in FIG. 2. The push-button 12 is securely connected with a reflector 20 which is guided in a housing 22 and sits on domes 24, 26 of a switching mat 28. The switching mat 28, in turn, lies on a printed circuit board 30. Upon an actuation of the push-button switch 10 by depressing on the push-button 12, the domes 24, 26 of the switching mat 28 are compressed by the reflector 20 and thus provide for a particular 'feel' which is experienced by the vehicle occupant.

Two light sources 32, 34, in particular LEDs, are arranged on the circuit board 30. The first light source 32, which is arranged in a bore 36 of an elevation 38 of the switching mat 28 projecting into the reflector 20, serves to illuminate the symbol 16 as required. The second light source 34 is arranged in a bore 40 of the dome 26 and is activated as a function of the switching status of the push-button switch 10.

The reflector 20 divides an internal structural space of the push-button switch 10 into two lighting areas, the division being realized substantially by a dividing wall 42 of the reflector 20. The first lighting area is constructed geometrically such that light of the first light source 32, entering into the reflector 20 via the bore 36 of the elevation 38, illuminates the transparent symbol 16 uniformly.

A light block 44 extends from the operating surface 14 of the push-button 12 into the bore 40 of the dome 26. In the bore 40 the second light source 34 is arranged. The light block 44 is held in the second lighting area of the reflector 20. The end of the light block 44 facing away from the second light source 34 forms the light outlet area 18 in the operating surface 14 of the push-button 12, which indicates to the vehicle occupant the current switching status of the push-button switch 10. The light block 44 is securely connected with the push-button 12 or with the reflector 20 and is accordingly moved with those upon an actuation of the push-button switch 10. The end of the light block 44 facing the second light source 34 moves in the bore 40 without the flexibility of the switching mat 28 being thereby impeded in the actuating direction. The function of the switching mat 28, namely providing a 'feel' which is able to be experienced by the vehicle occupant, is not impaired. The bore 40 of the dome 26 and the end of the light block 44 facing the second light source 34, however, accordingly enter into a form fit which provides for a fully off-partitioned or sealed light conducting section between the second light source 34 and the light outlet surface 18.

A reciprocal stray light influence of the two light sources 32, 34 is therefore ruled out, despite the compact construction, i.e. the illumination of the symbol 16 is not affected by the illumination of the light block 44, and vice versa.

A different light conductor or a correspondingly constructed light tunnel can also be provided instead of the light block 44.

The invention claimed is:

1. An electric push-button switch, comprising:

a housing, a push-button, a symbol lighting arrangement to illuminate a transparent region of the push-button, the transparent region symbolizing one of a plurality of functional units to be operated by the push-button switch and an actual function of a functional unit, and a function lighting arrangement to indicate an operating status of the functional unit, the symbol lighting arrangement comprising a first light source, the function lighting arrangement comprising a second light source and an off-partitioned light conducting section to a light outlet area which is integrated into the push-button, both lighting arrangements being accommodated in a structural space defined by the housing, wherein the light conducting section comprises a light conductor, a switching mat being arranged over the second light source, a form fit existing between the light conductor and the switching mat.

2. The electric push-button switch according to claim 1, wherein the two light sources are LEDs which are arranged directly on a common printed circuit board.

3. The electric push-button switch according to claim 1, wherein the push-button switch additionally comprises a reflector which divides an interior of the push-button switch into two lighting areas, the first lighting area restricting the outlet of the light of the first light source substantially to a transparent area, and the light conductor being held in the second lighting area.

4. The electric push-button switch according to claim 1, wherein the light conductor extends into a bore of the switching mat.

5. The electric push-button switch according to claim 4, wherein the light conductor is a light block which extends from the bore of the switching mat up to the push-button.

* * * * *